US008607878B2

(12) United States Patent
Knox

(10) Patent No.: US 8,607,878 B2
(45) Date of Patent: Dec. 17, 2013

(54) SYSTEM AND METHOD FOR CATHODIC PROTECTION OF A SUBSEA WELL-ASSEMBLY

(75) Inventor: Richard Knox, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 415 days.

(21) Appl. No.: 12/974,164

(22) Filed: Dec. 21, 2010

(65) Prior Publication Data

US 2012/0152559 A1 Jun. 21, 2012

(51) Int. Cl.
*E21B 43/01* (2006.01)
*C23F 13/00* (2006.01)

(52) U.S. Cl.
USPC ..... 166/345; 166/352; 166/368; 166/65.1; 204/196.01; 205/724

(58) Field of Classification Search
USPC ..... 166/345, 338, 344, 346, 351, 352, 364, 166/368, 242.4; 204/196.01, 196.3, 196.33, 204/196.34; 205/724
See application file for complete search history.

(56) References Cited

U.S. PATENT DOCUMENTS

| | | | | |
|---|---|---|---|---|
| 3,769,521 | A * | 10/1973 | Caldwell et al. | 204/196.03 |
| 4,090,170 | A * | 5/1978 | Lincklaen-Arriens et al. | 367/134 |
| 4,211,625 | A * | 7/1980 | Vandevier et al. | 204/196.05 |
| 4,309,734 | A * | 1/1982 | Warren | 361/58 |
| 4,484,838 | A * | 11/1984 | Stevens | 405/191 |
| 4,609,307 | A * | 9/1986 | Guy et al. | 205/731 |
| 4,629,366 | A * | 12/1986 | Rutherford et al. | 204/196.17 |
| 5,476,576 | A * | 12/1995 | Solomon et al. | 205/734 |
| 5,587,707 | A * | 12/1996 | Dickie et al. | 340/870.09 |
| 6,343,654 | B1 * | 2/2002 | Brammer | 166/338 |
| 6,461,082 | B1 * | 10/2002 | Smith | 405/211.1 |
| 7,102,532 | B2 * | 9/2006 | Hudson | 340/854.6 |
| 7,169,288 | B2 * | 1/2007 | Drapeau | 205/730 |
| 7,285,203 | B2 * | 10/2007 | Russell et al. | 205/725 |
| 7,425,249 | B1 * | 9/2008 | Britton | 204/196.27 |
| 7,635,237 | B2 * | 12/2009 | Spears et al. | 405/211.1 |
| 7,967,066 | B2 * | 6/2011 | McStay et al. | 166/250.01 |
| 8,151,890 | B2 * | 4/2012 | Spencer et al. | 166/352 |
| 8,154,296 | B2 * | 4/2012 | Guo et al. | 324/425 |
| 8,373,314 | B2 * | 2/2013 | Biester | 307/147 |
| 2008/0105562 | A1 * | 5/2008 | Simpson et al. | 205/724 |
| 2008/0217022 | A1 * | 9/2008 | Deans | 166/338 |
| 2009/0078585 | A1 * | 3/2009 | Dwars et al. | 205/724 |
| 2010/0126698 | A1 * | 5/2010 | Deivasigamani et al. | 165/104.19 |
| 2012/0001482 | A1 * | 1/2012 | Burdick | 307/9.1 |

FOREIGN PATENT DOCUMENTS

| | | | |
|---|---|---|---|
| GB | 2124382 | A | 2/1984 |
| GB | 2345504 | A | 7/2000 |
| GB | 2435770 | A | 9/2007 |
| GB | 2464972 | A | 5/2010 |
| GB | 2468117 | A | 9/2010 |

OTHER PUBLICATIONS

GB Search Report dated Jun. 22, 2012 from corresponding Application No. GB1121490.5.

* cited by examiner

*Primary Examiner* — Matthew Buck
(74) *Attorney, Agent, or Firm* — Bracewell & Giuliani LLP

(57) ABSTRACT

Disclosed herein is a subsea well assembly; wherein in an example embodiment the subsea well assembly includes an umbilical attached to a power source. The power source can be on a platform. Also included is a connector for connecting the umbilical to a receptacle included with the subsea well assembly and a subsea control module delivering power and control signals to the subsea well assembly. An impressed current protection module is integrated in the subsea control module that receives power from the umbilical.

10 Claims, 3 Drawing Sheets

SYSTEM AND METHOD FOR CATHODIC PROTECTION OF A SUBSEA WELL-ASSEMBLY

BACKGROUND OF THE INVENTION

1. Field of the Invention

This invention relates in general to subsea oil and gas production, and in particular to equipment and methods for protection a subsea well assembly from the corrosive effects of salt water using electrical charge.

2. Prior Art

Components of a subsea well production system, including the associated production wellhead, tree, and manifold, are generally built from steel, requiring protection to prevent the corrosion in seawater. Sacrificial cathodic protection is often used to protect the steel components. To perform cathodic protection, either aluminum or zinc sacrificial anodes are attached to well components, and the anodes corrode to produce an electrical current that protects the steel from corrosion.

Corrosion in seawater is an electrochemical process. During the chemical reaction of metals with the environment to form corrosion products (such as rust on steel), metallic atoms give up one or more electrons to become positively charged ions, and oxygen and water combine to form negatively charged ions. The reactions occur at rates, which result in no charge buildup. All the electrons given up by the metal atoms are consumed by the other reaction. Cathodic protection is a process that prevents the corrosion reaction by creating an electric field so that current flows into the metal. This prevents the formation of metal ions by setting up a potential gradient at the surface, which opposes the electric current produced by flow of electrically charged ions away from the metal surface as the product of corrosion. The electric field must be of a strength to counter the field produced by the corrosion reaction to ensure that metal ions are not formed. A source of the electric field that opposes the corrosion reaction may be a current supplied from the preferential corrosion of a metal anode with different electrochemical properties in the environment, and which has a stronger anodic reaction with the environment than does the offshore structure. Thus, current flows to the structure from the anode, which itself progressively corrodes in preference to the structure. This technique is known as sacrificial anode cathodic protection.

Though sacrificial anode cathodic protection are well functioning for the prevention of corrosion of the well production system, there are some problems with the passive system. The anodes used in the system must be appropriately placed and distributed through-out the well production system, i.e., on various components of the Christmas tree, to ensure an appropriate electrical field is induced by the electro-chemical reaction. The addition of these anodes greatly adds to the weight of the Christmas tree structure. Also, the anodes are generally not operable over the life of the well, which may be in production for 50 or more years. Finally, currents can affect the efficacy of the sacrificial system. Accordingly, the condition of the anodes must be monitored and failing anodes must be periodically replaced, which can be difficult depending upon the location of the anodes.

SUMMARY OF THE INVENTION

Disclosed herein is a subsea well assembly; wherein in an example embodiment the subsea well assembly includes an umbilical attached to a power source. The power source can be on a platform. Also included is a connector for connecting the umbilical to a receptacle included with the subsea well assembly and a subsea control module delivering power and control signals to the subsea well assembly. An impressed current protection module is integrated in the subsea control module that receives power from the umbilical. In another embodiment the subsea control module further includes a power pack having an inductor disposed therein; the power pack receives an alternating current signal from the umbilical and delivers power to components in the subsea control module. Also included with the subsea control module in the alternate embodiment is a subsea electronics module that is powered by the power pack. The subsea electronics module monitors various measurements in the wellhead assembly, including temperatures and pressures of various hydraulic lines and actuating directional control valves to control a flow of hydraulic fluid through the lines and valves of the well assembly and delivering power to the impressed current protection module. Yet further optionally, the subsea control module further includes a fluid reservoir connected to the directional control valves and a pump. In an example embodiment the fluid reservoir supplies hydraulic fluid to the wellhead assembly and includes outlet lines and return lines. The anode can be fabricated from zinc. Alternatively, further included are a plurality of anodes distributed along a sea floor. In one optional embodiment the impressed current protection module also include a positive terminal connected to the anode and a negative terminal that is connected the wellhead assembly. Optionally, the negative terminal can be connected to the housing of the subsea control module. In yet another alternative embodiment the impressed current protection module includes a transformer to adjust the power delivered to the anode and an AC to DC converter to convert an AC voltage from the transformer to a DC voltage for delivery to the anodes.

BRIEF DESCRIPTION OF THE DRAWINGS

So that the manner in which the features and advantages of the invention, as well as others, which will become apparent, may be understood in more detail, a more particular description of the invention briefly summarized above may be had by reference to the embodiments thereof, which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
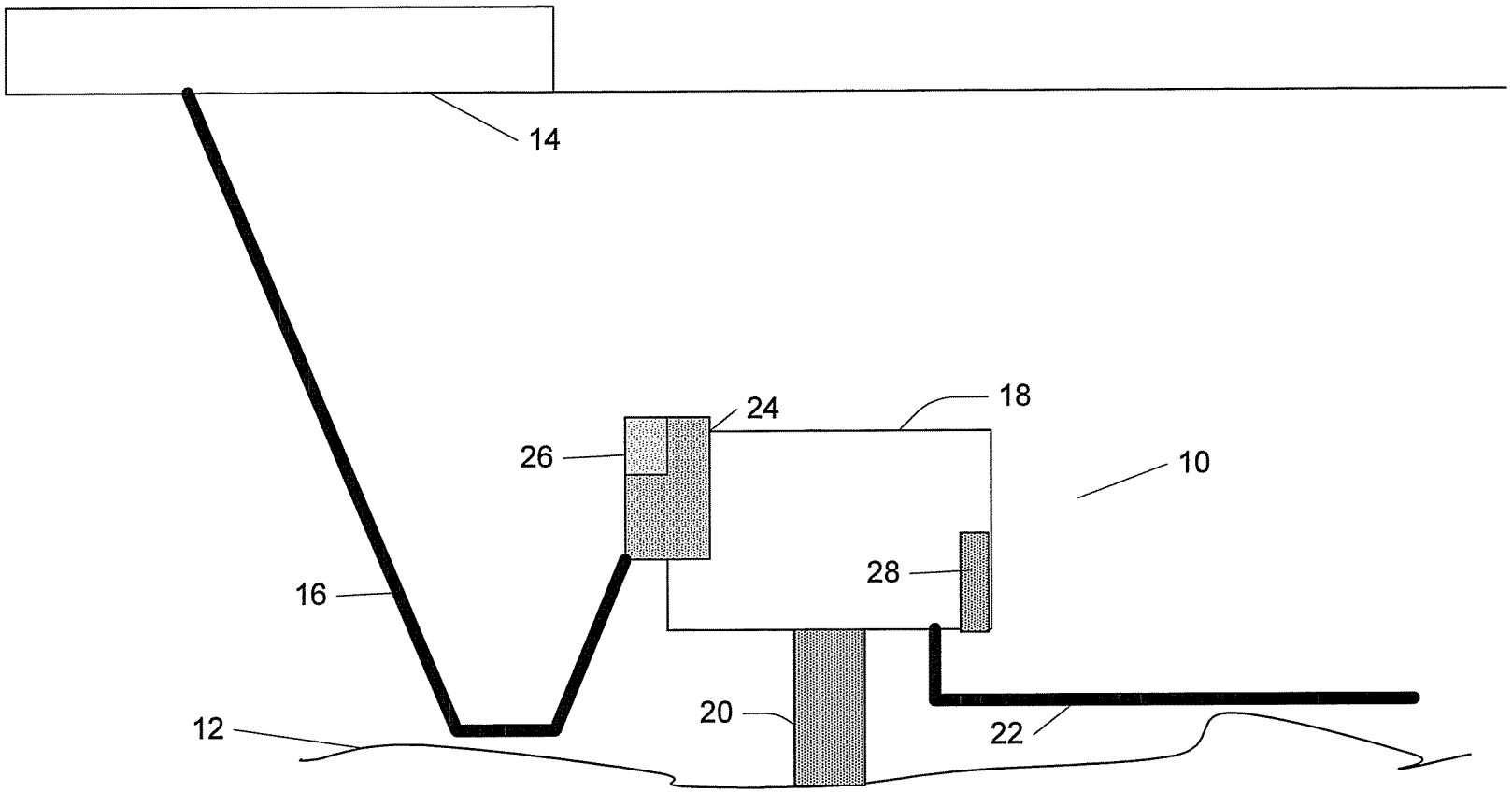
FIG. 1 is a schematic block diagram of a subsea well production system employing an impressed current protection system according to an embodiment of the invention.

A subsea well assembly is described with reference to FIG. 1. As can be seen, the subsea well assembly 10 is positioned on a sea bed 12, where it is connected to a platform 14 and command station (not shown) through umbilical 16. The wellhead assembly 10 may include a tree 18, a wellhead assembly 20, production pipeline 22, a subsea control module 24, and a impressed current protection module 26 and impressed current anode 28 according to an embodiment of the invention. As one skilled in the art will appreciate, the wellhead assembly 10 may include a tree 18, a wellhead assembly 20, production pipeline 22, a subsea control module 24 are configured in a conventional manner. For example, wellhead assembly 20 may include a wellhead housing, a tubing hanger spool, etc., that supports production tubing therein.

Platform 14 may be of a variety of types and will have a derrick and draw works for drilling and completion operations, and may also have a local control station located thereon for monitoring the condition of the subsea well assembly and controlling the subsea control module 24. An umbilical line 16 extends alongside, but is not within the subsea well assembly 10, and supplies electrical and hydraulic power. Umbilical line 16 comprises, within a jacket, a plurality of conductive wires for connecting to the housing to control the various functions of the subsea well assembly 10, and connects to same using an ROY. For example, a reciprocal connector (not shown) may plug into an engagement member of the subsea well assembly 10. Accordingly, subsea well assembly 10 has a receptacle (not shown) located on its sidewall that leads to various electrical components of subsea control module 24 located on the production tree 18. In some configurations, the reciprocal connector may also have a plunger that extends out and sealingly engages receptacle in the subsea assembly. As one skilled in the art will appreciate, though not specifically disclosed herein, such a connection mechanism is known in the art.

Figure 2:
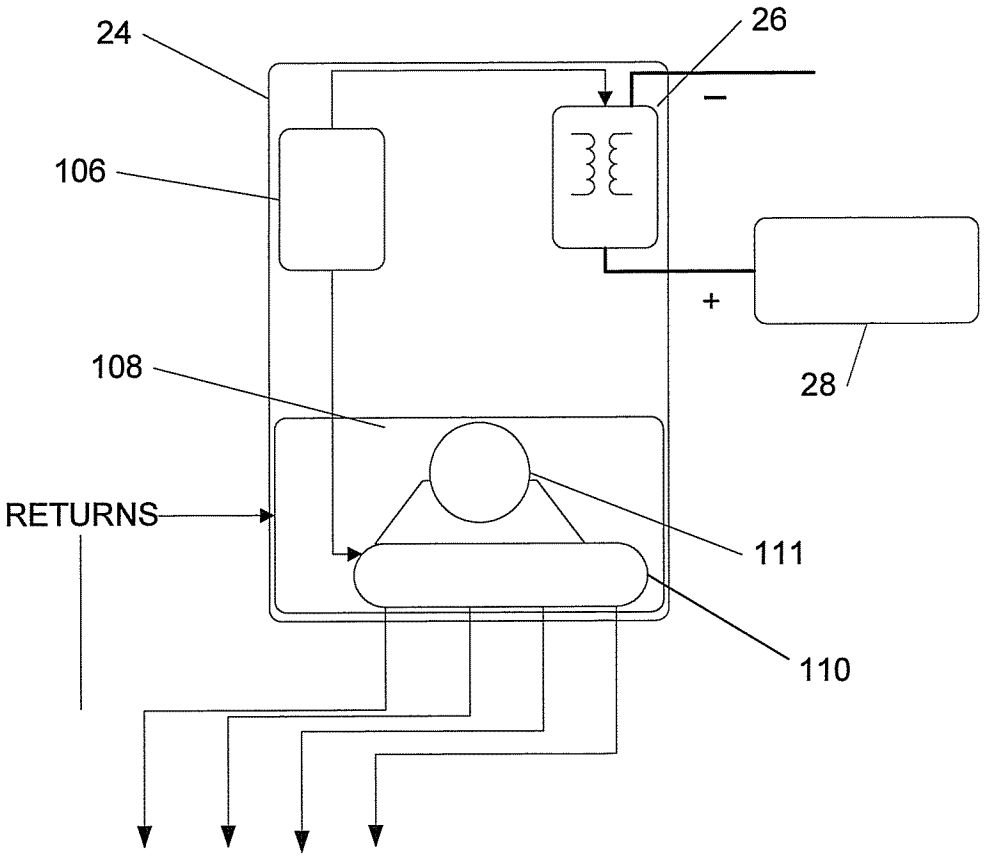
FIG. 2 is a block diagram of a subsea control module, the subsea control module include an impressed current protection system according to an embodiment of the invention.
Figure 3:
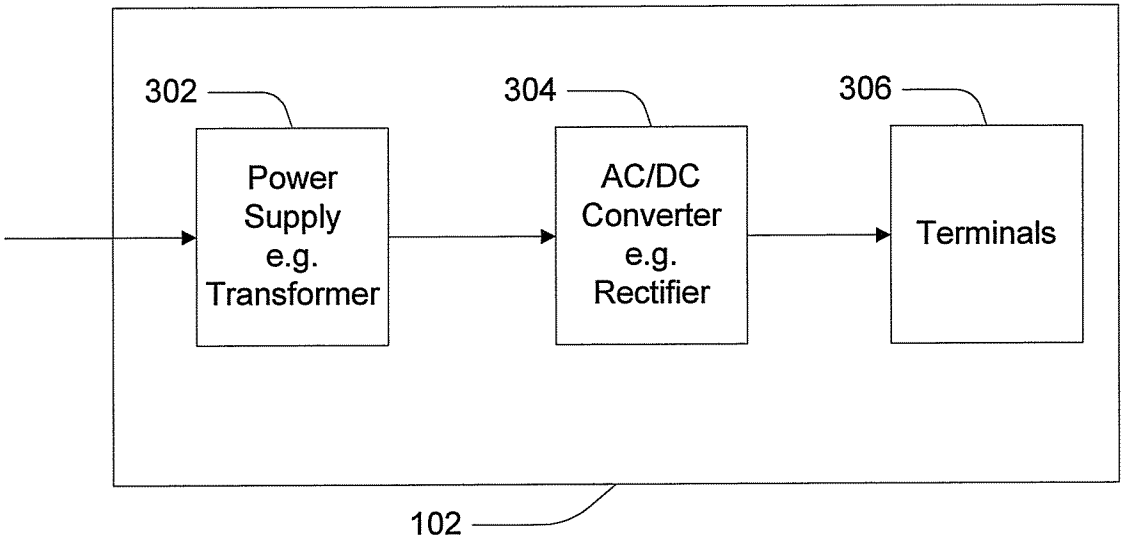
FIG. 3 is a block diagram of an impressed current protection system according to an embodiment of the invention.

A subsea control module 24 is disposed on the production tree. Subsea control module 24 is shown in FIGS. 2 and 3 and includes electrical and hydraulic controls that preferably include a hydraulic accumulator 108 that supplies pressurized hydraulic fluid upon receipt of a signal through umbilical 16. The function of subsea control module includes the conventional operation of fail-safe return production tree actuators and control of downhole valves, such as safety valves; flow control choke valves, shut-off valves, manifold diverter valves, chemical injection valves, etc.; monitoring of downhole pressure, temperature and flow rates, on the manifold and within the production tree, and control of hydraulic fluid stored in fluid reservoir 108. Umbilical 16 extends up to a control station [not shown] mounted on platform 14.

As shown in FIG. 2, subsea control module (SCM) 24 comprises the impressed current protection module 26, subsea electronics module (SEM) 106, fluid reservoir 108, pump 110, directional control valve module (DCV) 111, and anode 28. As shown in FIG. 3, impressed current protection module 26 comprises power supply 302, which could be e.g., a transformer, an AC/DC converter, e.g., a rectifier, and positive and negative terminals. The transformer receives power from, e.g., the umbilical through the subsea electronics module, and the transformer is used to step up or down the voltage. Alternatively, the impressed current protection module 26 could receive power from a power pack (not shown) integrated with in the subsea control module 24 to supply power to the various components. As one skilled in the art will appreciate, transformers can be use to pass an AC voltage from one circuit to another, to thereby act as a power source for the second circuit. In this instance, the transformer passes a voltage that is appropriate to create a suitable electric field within the anodes.

The transformer passes an AC voltage through an AC to DC converter 304 such as a rectifier to supply terminals 306 with a DC voltage. Terminals 306 consist of a positive terminal (connected to the anode) and a negative terminal, grounded on, e.g., the casing of the subsea control module, the wellhead, the tree and manifold, etc. The positive terminal is connected to anode 28, which can be fabricated from e.g. zinc, magnesium, etc., and together with the negative anode complete the impressed current circuit. As such, the impressed current protection system of the instant invention can be used with a plurality of well structures and wells.

Returning to FIG. 2, the subsea electronics module (SEM) 106 receives a signal from, e.g., a power pack (not shown) to power the functions thereof and may further convert the signal to a digital signal for use by some of the electronic components of the SEM 106, e.g., microcontrollers and other digital devices. In this way, the umbilical transmits both power and control signals from the control station to the subsea well assembly. SEM 106 monitors and controls the subsea equipment including all sensors, valves and external pumps and DCV modules, as is conventionally known in the art. As can be seen, DCVs 111 operate at the direction of SEM 106 to output hydraulic fluid stored in fluid reservoir 108 within the subsea well assembly using pump 110 to actuate flow.

An example of operation of the embodiment of FIG. 1 will now be described. An ROV (not shown) connects the umbilical to the reciprocal connector (not shown). This causes connector to advance into sealing engagement with receptacle on the subsea well assembly. The operator then provides power to the umbilical and to provide AC power and control signals to the SCM 24, which in turn powers the impressed current protection module. Once power is turned on to the impressed current protection module, the current from the anode 28, to the grounded "cathode", or wellhead assembly, is used to protect the wellhead assembly from corrosion.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

What is claimed is:

1. A subsea well assembly comprising:

a wellhead;

an umbilical connected to a power source on a surface platform;

a connector for connecting the umbilical to a receptacle in the subsea well assembly;

a subsea control module delivering power and control signals to components of the subsea well assembly;

at least one anode positioned to protect the well assembly from corrosion;

an impressed current protection module integrated in the subsea control module, the impressed current protection module receiving power from the umbilical to provide impressed current cathodic protection to the well assembly, the impressed current protection module comprising a positive terminal and a negative terminal, the positive terminal operably coupled to the at least one anode and the negative terminal operably grounded on one or more of the following: a housing of the subsea control module, the wellhead, a portion of a production tree or manifold associated with the wellhead.

2. A well assembly of claim 1, wherein the subsea control module further includes:

a power pack having an inductor disposed therein, the power pack adapted to receive an alternating current signal from the umbilical and adapted to deliver power to components in the subsea control module;

a subsea electronics module, powered by the power pack, and configured to deliver power to the impressed current protection module.

3. A well assembly of claim 2, wherein the subsea control module further includes:

a fluid reservoir, connected to directional control valves and a pump, the fluid reservoir supplying hydraulic fluid to the well assembly, the fluid reservoir having outlet lines and return lines.

4. A well assembly of claim 3, wherein the at least one anode is fabricated from zinc.

5. A well assembly of claim 4, wherein the at least one anode comprises a plurality of anodes distributed along a sea floor.

6. A well assembly of claim 1, wherein the negative terminal is connected to the housing of the subsea control module.

7. A well assembly of claim 1, wherein the impressed current protection module further comprises:

a transformer to adjust the power delivered to the at least one anode, and an AC to DC converter to convert an AC voltage from the transformer to a DC voltage for delivery to the at least one anode.

8. A well assembly as defined in claim 1, wherein the negative terminal is operably grounded on a portion of the production tree connected to the wellhead.

9. A well assembly as defined in claim 1, wherein the at least one anode is connected to a portion of the production tree connected to the wellhead.

10. A subsea well assembly comprising:

a wellhead;

an umbilical connected to a power source on a surface platform;

a connector for connecting the umbilical to a receptacle in the subsea well assembly;

a subsea control module delivering power and control signals to components of the subsea well assembly;

at least one anode positioned to protect the well assembly from corrosion;

a subsea electronics module configured to deliver power to an impressed current protection module; and the impressed current protection module integrated in the subsea control module to provide impressed current cathodic protection to the well assembly and comprising:

a power supply to receive power from the umbilical through the subsea electronics module, a positive terminal operably connected to the at least one anode, a negative terminal operably grounded on one or more of the following: a housing of the subsea control module, the wellhead, a portion of a production tree or manifold associated with the wellhead, and an AC to DC converter operably coupled to the power supply and operably coupled the positive and negative terminals.

* * * * *